US008419045B2

(12) United States Patent
Mantegazza

(10) Patent No.: US 8,419,045 B2
(45) Date of Patent: Apr. 16, 2013

(54) SLIDING BOARD, IN PARTICULAR SKI

(75) Inventor: Stefano Mantegazza, Pollone (IT)

(73) Assignee: Blizzard Sport GmbH, Mittersill (AT)

( * ) Notice: Subject to any disclaimer, the term of this patent is extended or adjusted under 35 U.S.C. 154(b) by 0 days.

(21) Appl. No.: 13/188,276

(22) Filed: Jul. 21, 2011

(65) Prior Publication Data

US 2012/0032417 A1 Feb. 9, 2012

(30) Foreign Application Priority Data

Jul. 22, 2010 (DE) ..... 10 2010 031 838

(51) Int. Cl.
*A63C 5/04* (2006.01)

(52) U.S. Cl.
USPC ..... 280/609

(58) Field of Classification Search ..... 280/11.14, 280/601–602, 607, 609, 610–611
See application file for complete search history.

(56) References Cited

U.S. PATENT DOCUMENTS

| | | | | |
|---|---|---|---|---|
| 5,427,401 | A * | 6/1995 | Liard | 280/609 |
| 5,673,926 | A | 10/1997 | Gauer | |
| 2008/0042400 | A1 | 2/2008 | Smith et al. | |
| 2008/0106068 | A1 | 5/2008 | Drake et al. | |
| 2008/0272575 | A1 | 11/2008 | Olson et al. | |
| 2011/0079986 | A1 | 4/2011 | Gradman et al. | |

FOREIGN PATENT DOCUMENTS

| | | | |
|---|---|---|---|
| AT | 505588 | A2 | 2/2009 |
| DE | 2711930 | A1 | 9/1978 |
| DE | 212006000050 | U1 | 3/2008 |
| DE | 202007018908 | U1 | 10/2009 |
| EP | 2082787 | A1 | 7/2009 |
| FR | 2786108 | A1 | 5/2000 |
| WO | 2010072819 | A1 | 7/2010 |

* cited by examiner

*Primary Examiner* — John Walters
*Assistant Examiner* — James Triggs
(74) *Attorney, Agent, or Firm* — Alleman Hall McCoy Russell & Tuttle LLP

(57) ABSTRACT

A sliding board, in particular a ski, comprising a front part, a middle part and a rear part with a contact surface comprising a running surface and metal edges bordering it. In accordance with the present disclosure, the contact surface of the non-loaded sliding board has a curvature development which, starting from a central contact line in the middle part which has a horizontal tangent, in each case has a positive curvature without turning points toward the front part and rear part.

17 Claims, 3 Drawing Sheets

SLIDING BOARD, IN PARTICULAR SKI

CROSS REFERENCE TO RELATED APPLICATION

This application claims priority to German Patent Application No. 10 2010 031 838.8, entitled "Sliding Board, in Particular Ski", filed Jul. 22, 2010, which is hereby incorporated by reference in its entirety for all purposes.

TECHNICAL FIELD

The present disclosure relates to a sliding board, in particular to a ski, comprising a front part, a middle part and a rear part with a contact surface comprising a running surface and metal edges bordering the running surface.

BACKGROUND AND SUMMARY

A sliding board is here to be understood as a snow sliding board which can be designed in the form of conventional skis, monoskis or of a snowboard.

The typical structure of a traditional sliding board results, for example, from DE 21 2006 000 050 U1. In addition to the material parameters and the thickness development, in particular the design of the running surface in a plan view and in a side view is relevant to the handling of the sliding board. In their current constructional shape, sliding boards usually have a waist which results in the effectively traveled radius in combination with the deflection of the ski which occurs. The skis have a concave turned-up front in the side view which form the tips in the front region. It is adjoined by a convex middle region and this in turn by a concave turned-up end. The middle region or the center part has an upwardly inclined convex curvature which mergers toward the ends into the concave negative curvature so that two turning points are formed here. The non-loaded ski, which lies flat on the ground, is thus bounded in its contact surface, that is the contact region, by a rear and front contact line on the lower side of the ski toward the snow. The preload is defined as the curve development between the contact lines with the ski lying flat on a planar base.

During carving, when the sliding board is guided through the curve set onto its edge, it deforms elastically in the middle region as a consequence of the loads which occur so that the originally concave curvature temporarily becomes a convex curvature. As a superimposition of the deformation condition adopted as a consequence of the load, of the lateral waist and the edge tilt angle (that is the angle between the sliding surface and the subsurface for the case that the sliding board is set onto its edge), the side edge lying on the subsurface describes a substantially circular arc which in the ideal case corresponds to the turn to be made.

The sliding board influences the control behavior and the handling of the sliding board substantially, independently of the waist and of the mechanical properties of the ski contact region both in its length and in its preload height.

The aforesaid curvature development is also already described in DE 299 20 650 U1. Specifically the tip and tail regions of the sliding board are furthermore defined.

A sliding board is known from DE 20 2007 018 908 U1 whose front contact region is described having a tip length of more than 0.5 m.

Finally, the interaction between the waist and the preload development results from EP 2 082 787 A.

Skis are also already known from the beginnings of skiing which do not yet have the aforesaid shape. The wooden boards manufactured under the name "Fasstauben" in German ("barrel staves") are, however, not comparable in the waist and in the structure with modern skis.

It is the object of the present disclosure to improve the control and the handling of a sliding board, in particular of a ski, by optimization of the contact curve so that a lower turn triggering moment is required to trigger a turn and so that an improved sliding and floating of the ski on snow is made possible.

In accordance with the present disclosure, the aforesaid object is achieved by a contact surface of a sliding board which comprises a front part, a middle part and a rear part. The contact surface has a curvature development in the non-loaded state which, starting from a central contact line in the middle part which has a horizontal tangent, has a positive curvature without turning points in each case toward the front part and rear part. An accurate positive curvature line of the lower contact surface of the sliding board is therefore hereby achieved. The contact lines known from the prior art are thereby displaced to form a single central contact line in the binding mounting region. The development can be described by a so-called constant spline curve of different curves without a turning point having a horizontal tangent in the region of the central contact line.

The specific curve development of the sliding board in use results from the stiffness behavior, the waist and other construction details of the ski.

An easier turnability of the sliding board can be achieved by this construction, particularly with difficult piste conditions. A higher guidance stability results with a more solid central construction even if the sliding board is only slightly set on edge.

It is particularly advantageous that the sliding board does not have to be deflected to achieve the lateral contact of the edges in the state set on edge. A smaller application of force hereby results during skiing or snowboarding. Due to the smaller application of force, a neutral position is possible which in turn results in increased safety during skiing or snowboarding. A better sliding and floating of the sliding board is possible by an overall smaller snow resistance.

Preferred embodiments of the present disclosure result from the subordinate claims dependent on the main claim.

The sliding bed is accordingly advantageously laterally waisted. The narrowest point of the sliding board amounts to at least 0.07 m at the middle part. The lateral curve of the waist is preferably composed of different radii. These radii advantageously amount to between 10 and 30 m.

It is particularly advantageous to form the upper side of the sliding board disposed opposite the contact surface as flat in the middle part and in each case to curve it at least toward the ends in the front part and rear part. An additional reinforcement which is designed as comparatively thicker hereby results in the binding mounting region. A harmonious edge pressure is in particular achieved in the binding mounting region.

Instead of a flat surface, the sliding board can, however, also have a concave or convex surface, whereby the stiffness behavior can be set directly.

Finally, the central contact line is arranged in a region which extends 0.3 m before and after the binding mounting point on the surface.

Further features, details and advantages of the present disclosure result from the following description of a preferred embodiment of the present disclosure.

DETAILED DESCRIPTION

The present disclosure directed to the sliding board will be explained in more detail in the following with reference to an Alpine ski. These explanations apply in the same manner to other types of ski, for example monoskis, but also to snowboards.

Figure 1:
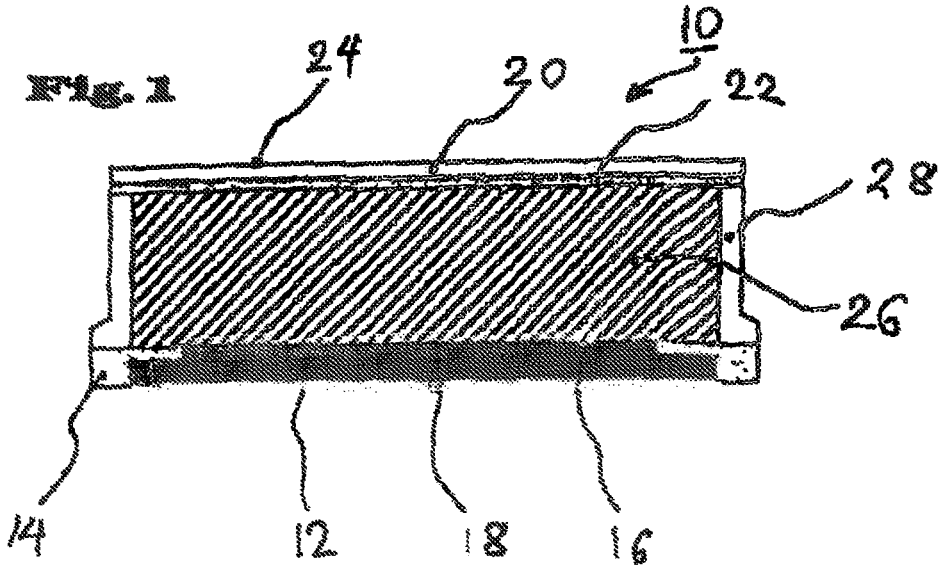
FIG. 1 shows a cross-section through the sliding board in accordance with the present disclosure.
Figure 2:
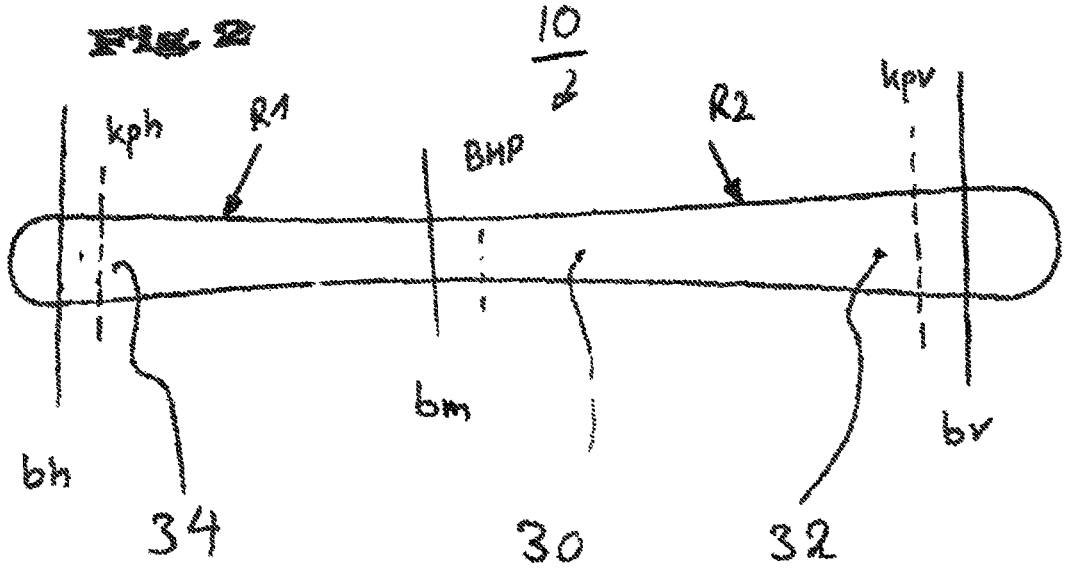
FIG. 2 shows a plan view of a ski in accordance with the present disclosure which also corresponds to that in accordance with the prior art.

The cross-section of a ski 10 having the basic ski components is shown in FIG. 1. The ski 10 has a substructure in which a running surface 12 is bounded by lateral metal edges, for example steel edges 14. A reinforcement 16 is formed in a known manner toward the interior of the ski and adjacent to the running surface 12. The surface 18 comprising the running surface 12 and the lower side of the steel edges 14 represents the contact surface to the snow. The upper part of the ski 10 is substantially formed by a surface 20 and a top chord reinforcement 22. The surface disposed opposite the contact surface 18 and arranged at the upper side of the ski 10 is called the upper surface 24. The intermediate space between the substructure and the upper part is filled by means of a core material 26 which is laterally bordered by side supports 28 in the embodiment shown here In FIG. 2, the plan view is shown which comprises a middle part 30, a front part 32 and a rear part 34. As can be seen from FIG. 2, the ski is designed with a waist. The waist has its narrowest point bm in the middle part 30. The widest point in the rear ski part 34 is marked by bh and the widest point in the front ski part 32 is marked by bv. The waist curve can be formed from different circle segments such as is shown in FIG. 2 with the circle segments having the radii R1 and R2. The waist can, however, also be manufactured from any desired radii. The use of a single radius would also be possible. In FIG. 2 the so-called binding mounting point is furthermore drawn as BMP which defines the central binding mounting position. This central binding mounting position corresponds to a usual marking at the sole of a shoe.

Figure 3:
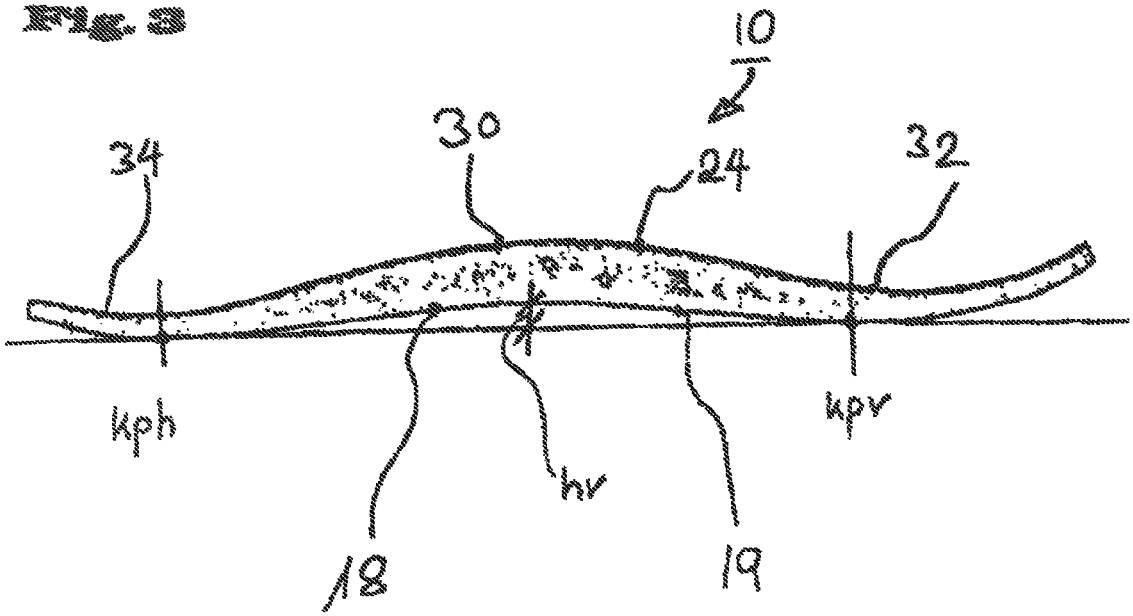
Prior Art Fig. 3
FIG. 3 shows a longitudinal section having a corresponding curve development of a conventional ski in accordance with the prior art.

In FIG. 3, the curvature development of a conventional ski 10' can be recognized from the longitudinal section. A concave turned-up tip is here produced at the front part 32' which is adjoined by a convex middle part 30' and in turn a concave rear part 34'. Two turning points are thus formed in the curve development of the side view which form the front contact line kpv and the rear contact line kph. These contact lines kpv in the front part and kph in the rear part bound the contact surface of the total ski. The maximum preload is designated by hv in FIG. 3. The respective ski thickness, which is also responsible for the stiffness of the ski, is produced from the spacing between the contact surface 18 and the surface 24'. In FIG. 3, components are labeled with similar numbering as elsewhere, but with a prime.

The contact lines kpv and kph are also drawn in chain-dotted lines in FIG. 2. The preload curve is formed between these contact points with a flat ski lying freely on the ground. Said preload curve is the largest in the middle region between the contact lines KPV and KPH as is shown in FIG. 3 by specification of the maximum preload HV.

Figure 4:
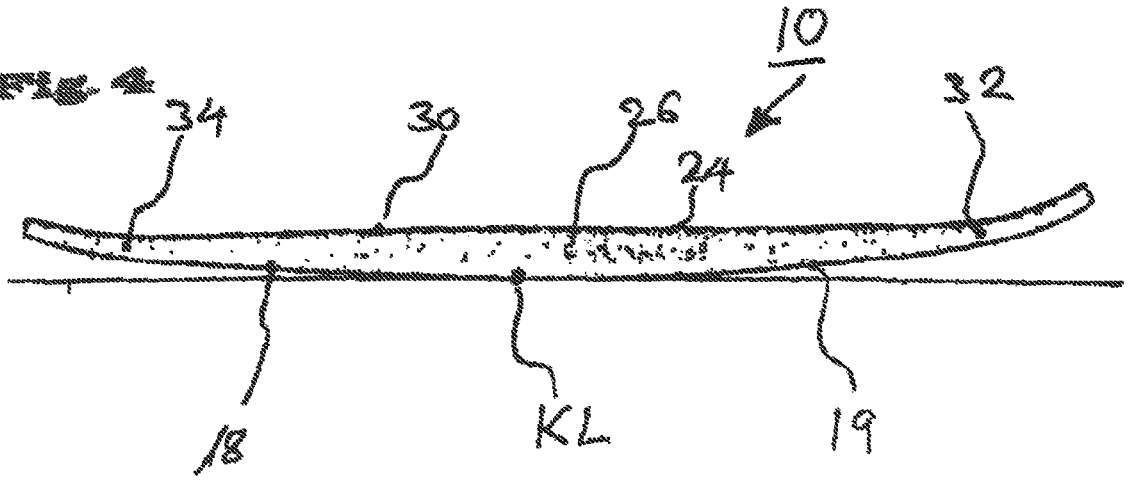
FIG. 4 shows a longitudinal section with a corresponding curvature development for a sliding board in accordance with the present disclosure.

The structure of the ski 10 in accordance with the present disclosure results from FIG. 4. The contact surface 18 of the non-loaded ski 10 has a curvature development which, starting from a central contact line KL in the middle part, which has a horizontal tangent, in each case has a positive curvature without turning points toward the front part 32 and rear part 34. A positive preload development is hereby represented, so-to-say. The contact surface 18 simultaneously forms the preload line 19 and represents a constant spline curve comprising different curves without a turning point, with the central contact line KL being arranged in the middle part. The preload curve 19 is already clearly raised from the support in the front part 32 and in the rear part 34 of the ski 10.

As becomes clear in FIG. 4, the upper surface 24 is made flat in the middle part, whereas it curves upwardly toward the front part 32 and the rear part 34. The core 26 in the middle part is hereby made thicker than the front part 32 or the rear part 34. In this respect, the stiffness of the ski can be varied over its length. The ski advantageously has at least a flat middle part of 1 m length with a minimum total length of 1.5 m.

The effect of the different preload of the ski in accordance with the prior art, as is shown in FIG. 3, and the ski in accordance with the present disclosure, as is shown in FIG. 4, can be seen from the diagrams 5 and 6, respectively, in which the edge pressure distribution with the ski set on edge is shown.

Figure 5:
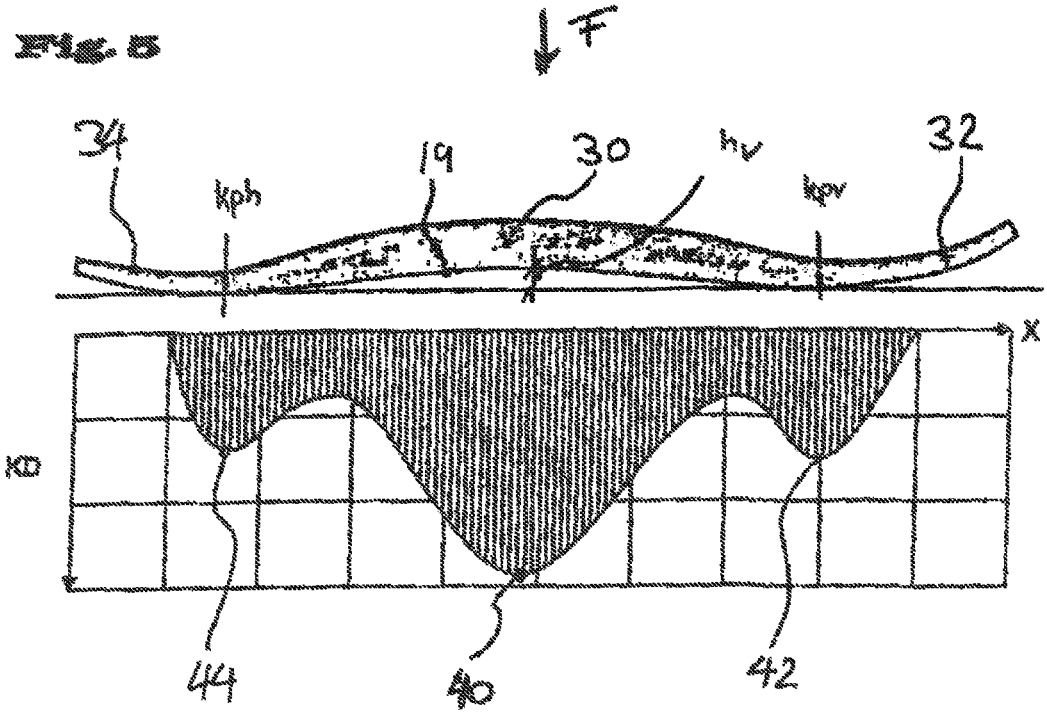
FIG. 5 shows a diagram of the surface pressure distribution or edge pressure distribution in a sliding board in accordance with the prior art.
Figure 6:
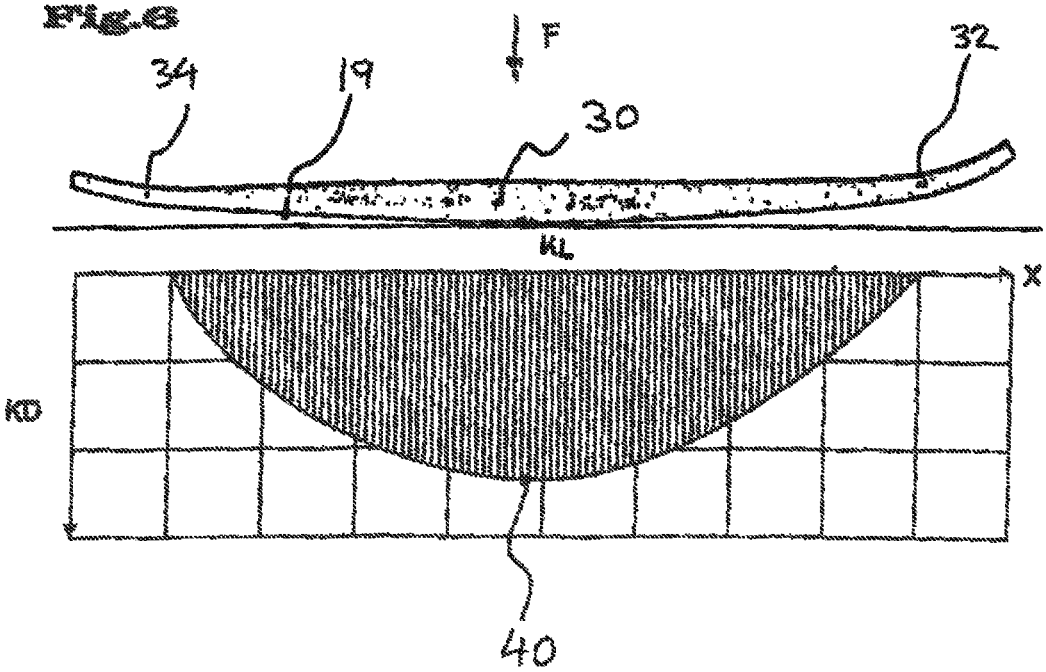
FIG. 6 shows a diagram corresponding to FIG. 5 in which the surface pressure distribution or edge pressure distribution of a sliding board in accordance with the present disclosure is shown. The figures are drawn approximately to scale.

In this respect, FIG. 5 represents the corresponding edge pressure distribution KD, drawn as a diagram, of a conventional ski which is loaded by a force F. In FIG. 6, in contrast, the edge pressure distribution KD of a ski in accordance with the present disclosure loaded by a force F is shown.

If a conventional ski is loaded in accordance with FIG. 3 in the binding region by a force F, the edge pressure development in accordance with FIG. 5 is produced. In the central load region, that is in the region of the middle part 30, a pronounced maximum 40 of the edge pressure distribution is adopted with an applied force 11. Maxima 42 and 44 respectively are, however, also adopted in the contact regions kpv and kph in the front part 32 and rear part 34 respectively.

From FIG. 6, the edge pressure distribution is shown in the ski in accordance with the present disclosure, with here a clear maximum 40 being formed in the middle region on application of a force F, said maximum leveling out continuously toward the ends 32 and 34 without any other local maxima or minima (besides the end points).

The invention claimed is:

1. A sliding board, comprising:

a front part, a middle part and a rear part with a contact surface comprising a running surface and metal edges bordering the running surface, wherein in a non-loaded state of the sliding board, the contact surface has a curvature development which, starting from a central contact line in the middle part which has a horizontal tangent, has a positive curvature without turning points toward the front part and rear part, wherein the central contact line is arranged in a region which extends 0.3 m before and behind a binding mounting point on the contact surface.

2. A sliding board in accordance with claim 1, wherein the sliding board has a lateral waist in its plan view.

3. A sliding board in accordance with claim 2, wherein a narrowest point in the middle part amounts to at least 0.07 m.

4. A sliding board in accordance with claim 2, wherein a side curve of the waist is composed of different radii.

5. A sliding board in accordance with claim 4, wherein the radii amount to between 10 and 30 m.

6. A sliding board in accordance with claim 4, wherein an upper side of the sliding board disposed opposite the contact surface is made flat in the middle part and is curved at least toward the ends in the front part and rear part.

7. A sliding board, comprising:

a front part, a middle part and a rear part with a contact surface comprising a running surface and metal edges bordering the running surface, wherein in a non-loaded state of the sliding board, the contact surface has a curvature development which, starting from a central contact line in the middle part which has a horizontal tangent, has a positive curvature without turning points toward the front part and rear part, wherein the sliding board has a lateral waist in its plan view, wherein a side curve of the waist is composed of different radii, wherein an upper side of the sliding board disposed opposite the contact surface is made flat in the middle part and is curved at least toward the ends in the front part and rear part, wherein the sliding board has a total length of at least 1.5 m, with the middle part, which is flat, being at least 1 m long.

8. The sliding board in accordance with claim 1, wherein the sliding board is a ski.

9. A sliding board, comprising:

a front part, a middle part and a rear part with a contact surface comprising a running surface and metal edges bordering the running surface, wherein in a non-loaded state of the sliding board, the contact surface has a curvature development which, starting from a central contact line in the middle part which has a horizontal tangent, has a positive curvature without turning points toward the front part and rear part, wherein in the non-loaded state of the sliding board, the contact surface has a curvature development which, has the positive curvature without turning points toward the front part and also toward the rear part, and wherein an edge pressure distribution generated from application of a downward force on a binding mounting point generates only a single maximum in the middle part leveling out continuously to minimums at front and rear ends without any other local maxima or minima.

10. A sliding board, comprising:

a front part, a middle part and a rear part with a contact surface comprising a running surface and metal edges bordering the running surface, wherein in a non-loaded state of the sliding board, the contact surface has a curvature development which, starting from a central contact line in the middle part which has a horizontal tangent, has a positive curvature without turning points toward the front part and also toward the rear part without interruption from the central contact line, and wherein an edge pressure distribution generated from application of a downward force on a binding mounting pint generates only a single maximum in the middle part leveling out continuously to minimums at front and rear ends, wherein the sliding board is an alpine ski.

11. A sliding board in accordance with claim 10, wherein the sliding board has a lateral waist in its plan view.

12. A sliding board in accordance with claim 11, wherein a narrowest point in the middle part amounts to at least 0.07 m, and wherein a side curve of the waist is composed of different radii in the plan view.

13. A sliding board in accordance with claim 12, wherein the radii amount to between 10 and 30 m.

14. A sliding board in accordance with claim 13, wherein an upper side of the sliding board disposed opposite the contact surface is made flat in the middle part and is curved at least toward the ends in the front part and rear part.

15. A sliding board in accordance with claim 14, wherein the sliding board has a total length of at least 1.5 m, with the middle part, which is flat, being at least 1 m long.

16. A sliding board in accordance with claim 15, wherein the central contact line is arranged in a region which extends 0.3 m before and behind the binding mounting point on the contact surface.

17. A sliding board, comprising:

a front part, a middle part and a rear part with a contact surface comprising a running surface and metal edges bordering the running surface, wherein in a non-loaded state of the sliding board, the contact surface has a curvature development which, starting from a central contact line in the middle part which has a horizontal tangent, has a positive curvature upward away from a ground surface without turning points toward the front part and also toward the rear part without interruption from the central contact line, and wherein an edge pressure distribution generated from application of a downward force on a binding mounting point generates only a single maximum in the middle region leveling out continuously to minimums at front and rear ends, wherein the sliding board is an alpine ski that has a lateral waist in its plan view with a narrowest point in the middle part amounts, and with side curves outwardly from the waist is of different radii.

* * * * *